US005907310A

United States Patent [19]

Seewig et al.

[11] Patent Number: 5,907,310

[45] Date of Patent: May 25, 1999

[54] DEVICE FOR COVERING THE APERTURE OF AN ANTENNA

[75] Inventors: Udo Seewig, Langenhagen; Daniel Wojtkowiak, Neustadt, both of Germany

[73] Assignee: Alcatel, France

[21] Appl. No.: 08/868,742

[22] Filed: Jun. 4, 1997

[30] Foreign Application Priority Data

Jun. 12, 1996 [DE] Germany ..... 296 10 283 U

[51] Int. Cl.[6] ..... H01Q 13/00; H01Q 1/02; H01Q 1/42

[52] U.S. Cl. ..... 343/786; 343/781 R; 343/704; 343/872

[58] Field of Search ..... 343/786, 781 R, 343/704, 872, 840

[56] References Cited

U.S. PATENT DOCUMENTS

| | | | |
|---|---|---|---|
| 4,626,863 | 12/1986 | Knop et al. | 343/781 P |
| 4,689,633 | 8/1987 | Saad et al. | 343/786 |
| 5,317,328 | 5/1994 | Allen | 343/786 |
| 5,714,963 | 2/1998 | Cox | 343/786 |

FOREIGN PATENT DOCUMENTS

| | | |
|---|---|---|
| 2 669 469 | of 0000 | France . |
| 2842298 A1 | of 0000 | Germany . |
| 44 36 596 | of 0000 | Germany . |
| 4436596 A1 | of 0000 | Germany . |
| OS 2163168 | of 0000 | Germany . |

OTHER PUBLICATIONS

European Conference on Radio Relay Systems, Edinburgh, Oct. 11–14, 1993, Pub. No. 386.

War's das? Die Interstat '95—Apr. 1995, pp. 22–23.

Patent Abstracts of Japan, 4–240902(A), E–1303, Jan. 8, 1993, vol. 17, No. 9.

Patent Abstracts of Japan, 59–21103(A), E–244, May 15, 1984, vol. 8, No. 103.

Patent Abstracts of Japan, 62–274903(A), E–610, May 19, 1988, vol. 12, No. 167.

*Primary Examiner*—Frank G. Font
*Assistant Examiner*—Roy M. Punnoose
*Attorney, Agent, or Firm*—Ware, Fressola, Van der Sluys & Adolphson LLP

[57] ABSTRACT

A device is indicated for covering the aperture of an antenna having a parabolic reflector and an exciter. The cover is made of a rigid material. The cover includes a shield ring connected to the reflector and a plastic cover shaped like a flat or obtuse cone having a conical portion which closes the open end of the reflector. The wall of the conical portion of the cover forms an angle between 4° and 6° with a plane that is at a right angle to the axis of the shield ring.

8 Claims, 1 Drawing Sheet

DEVICE FOR COVERING THE APERTURE OF AN ANTENNA

BACKGROUND OF THE INVENTION

1. Technical Field

The invention concerns a device for covering the aperture of an antenna which has a parabolic reflector and an exciter. A cover is made of a rigid material, whose outside diameter corresponds to the diameter of the reflector and is arched outward on the side that faces away from the reflector.

2. Description of the Prior Art

Covers are placed on antennas mainly to protect them from the effects of weather. Deposits of dirt, moisture and ice can unfavorably affect the transmission properties of antennas. Ice can furthermore add considerable weight to the antennas and can cause them mechanical damage.

In a known device according to DE 44 36 596 A1, a flexible foil is used on the outside of a rigid dielectric cover hood which arches outward, and is stretched over the antenna aperture with an outward inclining surface. The foil moves constantly when the wind blows on the antenna. This is to prevent frost deposits from accumulating. This device is costly to produce and costly to install. In case of necessity, the antenna and its exciter system can only be accessed by removing the foil and the cover hood.

SUMMARY OF THE INVENTION

It is an object to simplify the construction and the installation of the above-described device. This object is fulfilled by the invention in that the cover is constructed of a shield ring which is connected to the reflector, and a plastic cover to close its open end which is built as a flat or obtuse cone and whose wall of the conical portion forms an angle between 4° and 6° with a plane that is at a right angle to the axis of the shield ring.

Such a device for protecting antennas is simple to construct and simple to install. It has only one part, namely the cover when the shield ring is made into one piece with the reflector. The cover, which is constructed as a flat or obtuse cone, exerts no disturbing influence on the electro-magnetic properties of the antenna. This applies particularly to the antenna's radiation pattern which is not, or at least not significantly, affected in a negative way. Its outward inclination furthermore ensures that dirt, moisture and ice cannot form on the antenna in any significant amount.

The invention will be fully understood when reference is made to the following detailed description taken in conjunction with the accompanying drawings.

BRIEF DESCRIPTION OF THE DRAWING

The drawing illustrates a configuration example of the subject of the invention, wherein.

DETAILED DESCRIPTION OF THE INVENTION

Figure 1:
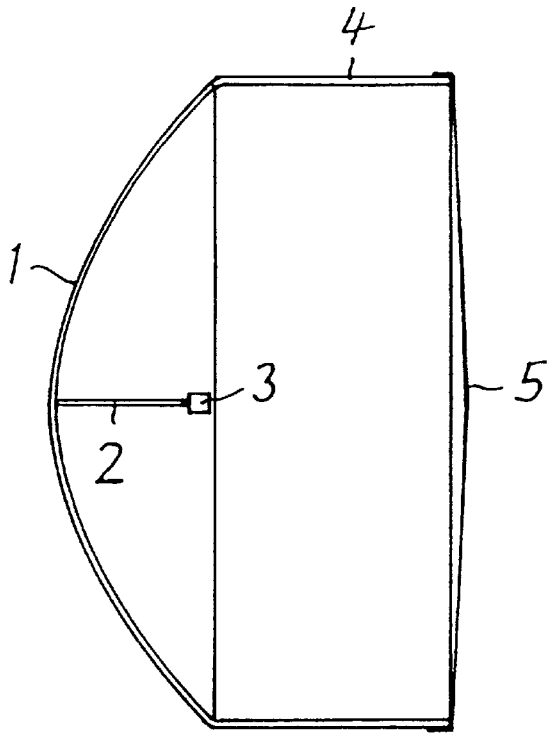
FIG. 1 schematically illustrates a cross section of the reflector of an antenna with a cover.

Referring to FIG. 1, a parabolic reflector 1 of a directional antenna for transmitting electro-magnetic waves in at least one desired frequency has an exciter 3 connected through a feeder line 2. The aperture of the exciter 3 is located in the focal point of the reflector 1. In a "Cassegrain" configuration, the antenna could also be equipped with a subreflector.

Figure 2:
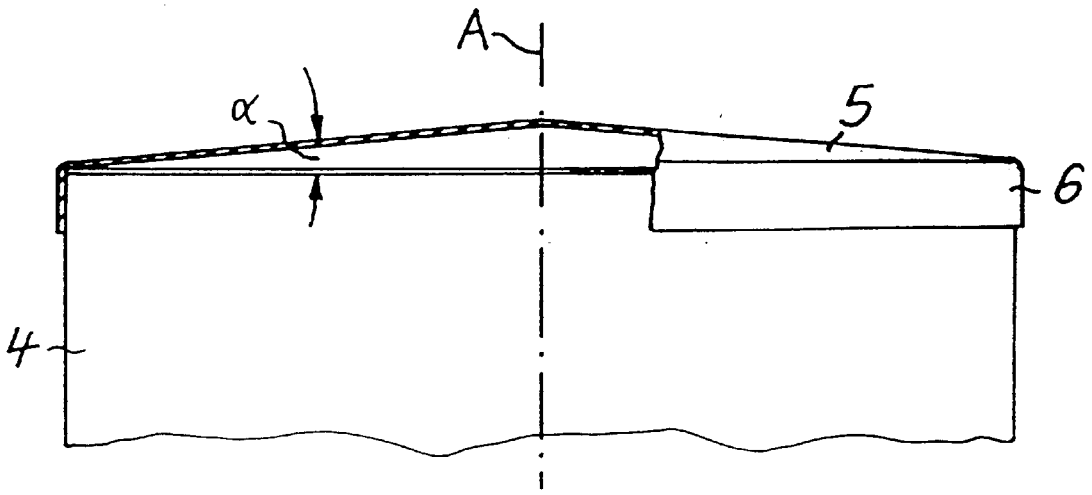
FIG. 2 is an enlarged side view of a part of the cover device with a portion of the shield ring and cover broken away to reveal internal structure.

An approximately cylindrical shield ring 4 is attached to the reflector 1 and its outside diameter corresponds to the diameter of the reflector 1. The shield ring 4 is made integral with the reflector 1, particularly in small-size antennas. It is therefore formed with the reflector 1 when the latter is manufactured. However, the shield ring 4 can also be a separate part, in which case, it is subsequently connected to the reflector 1. The shield ring 4 is closed off by a plastic cover 5 on the side that faces away from the reflector 1. The cover 5 is arched outward. Its more detailed construction can be seen in FIG. 2.

The cover 5 is constructed as a flat or obtuse cone. Its wall forms an angle $\alpha$ between 4° and 6° with a plane that is at a right angle to the axis A of the shield ring 4. It measures 5° for example. The wall thickness of the cover 5 is a function of frequency. For example, it is in a range between 1.5 mm and 8.5 mm for the range of 10 to 60 GHz.

In a preferred configuration, the cover 5 is produced by means of injection molding. It has a cylindrical peripheral edge 6 for attachment to the shield ring 4. To that end, screws can be used for example. The material is preferably a high-grade dielectric plastic such as an acrylnitril-styrol-acrylester-polymer (ASA) for example.

The preferred embodiment described above admirably achieves the objects of the invention. However, it will be appreciated that departures can be made by those skilled in the art without departing from the spirit and scope of the invention which is limited only by the following claims.

What is claimed is:

1. A covered directional antenna for transmitting electro-magnetic waves in at least one desired frequency comprising:

(a) a parabolic reflector having a diameter and an exciter, adapted to transmit a directional beam aligned with a central axis of said parabolic reflector;

(b) a cover device connected to the parabolic reflector, the cover device having an outside diameter generally corresponding to the diameter of the reflector, the cover device being made of a rigid material, the cover device having a shield ring with an open end and a central axis, and a plastic cover which arches outward on a side that faces away from the parabolic reflector, the plastic cover having a conical portion which closes the open end of the shield ring, wherein, in order minimize both disturbance to a radiation pattern of said directional antenna and adhesion of ambient moisture and dirt to said cover, the conical portion forms an angle in a range of between 4° and 6° with a plane that is at a right angle to the central axis of the shield ring.

2. An antenna as claimed in claim 1, wherein the conical portion of the plastic cover forms a 5° angle with the plane that is at a right angle to the central axis of the shield ring.

3. An antenna as claimed in claim 2, wherein the plastic cover is made of dielectric plastic.

4. An antenna as claimed in claim 3, wherein the conical portion of the plastic cover has a wall thickness between 1.5 mm and 8.5 mm as a function of the at least one desired frequency of the electro-magnetic waves being transmitted.

5. An antenna as claimed in claim 2, wherein the conical portion of the plastic cover has a wall thickness between 1.5 mm and 8.5 mm as a function of the at least one desired frequency of the electro-magnetic waves being transmitted.

6. An antenna as claimed in claim 1, wherein the plastic cover is made of dielectric plastic.

7. An antenna as claimed in claim 6, wherein the conical portion of the plastic cover has a wall thickness between 1.5 mm and 8.5 mm as a function of the at least one desired frequency of the electro-magnetic waves being transmitted.

8. An antenna as claimed in claim 1, wherein the conical portion of the plastic cover has a wall thickness between 1.5 mm and 8.5 mm as a function of the at least one desired frequency of the electro-magnetic waves being transmitted.

* * * * *